US007493958B2

(12) United States Patent
Hromas et al.

(10) Patent No.: US 7,493,958 B2
(45) Date of Patent: Feb. 24, 2009

(54) TECHNIQUE AND APPARATUS FOR MULTIPLE ZONE PERFORATING

(75) Inventors: Joe C. Hromas, Sugar Land, TX (US); Larry Grigar, East Bernard, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 341 days.

(21) Appl. No.: 10/908,037

(22) Filed: Apr. 26, 2005

(65) Prior Publication Data

US 2005/0178554 A1 Aug. 18, 2005

Related U.S. Application Data

(63) Continuation-in-part of application No. 10/686,043, filed on Oct. 15, 2003, now Pat. No. 7,152,676.

(60) Provisional application No. 60/419,718, filed on Oct. 18, 2002.

(51) Int. Cl.
*E21B 43/12* (2006.01)

(52) U.S. Cl. ..... 166/297; 166/313; 175/4.6

(58) Field of Classification Search ..... 166/297, 166/313; 175/4.6
See application file for complete search history.

(56) References Cited

U.S. PATENT DOCUMENTS 3,627,066 A * 12/1971 Johnson ..... 175/4.53
3,863,718 A 2/1975 Bruist
4,372,384 A 2/1983 Kinney
4,547,298 A 10/1985 Novak
4,627,496 A 12/1986 Ashford et al.
5,165,478 A 11/1992 Wilson
5,224,556 A 7/1993 Wilson et al.
5,228,518 A 7/1993 Wilson
5,346,016 A 9/1994 Wilson
5,379,838 A 1/1995 Wilson et al.
5,445,228 A 8/1995 Rathmell et al.
5,467,823 A 11/1995 Babour
5,494,107 A 2/1996 Bode
5,660,232 A 8/1997 Reinhardt
5,829,538 A 11/1998 Wesson et al.
5,881,814 A 3/1999 Mills
5,890,538 A 4/1999 Beirute et al.
5,971,072 A 10/1999 Huber
6,009,947 A 1/2000 Wilson (Continued)

FOREIGN PATENT DOCUMENTS

EP 0288237 10/1988

(Continued)

*Primary Examiner*—William P Neuder
(74) *Attorney, Agent, or Firm*—James L. Kurka; Trop, Pruner & Hu P.C.; Kevin McGoff

(57) ABSTRACT

A technique that is usable with a well includes running a production string into the well so that the production string extends through a first isolated zone of the well and at least into a second isolated zone that is located farther into the well than the first isolated zone. The production string includes integrated perforating charges. The technique also includes firing the perforating charges inside the first zone; and after the firing, maintaining fluid isolation between the first isolated zone and a passageway of the production string. The passageway communicates well fluid from the second isolated zone.

22 Claims, 15 Drawing Sheets

U.S. PATENT DOCUMENTS

| | | | | |
|---|---|---|---|---|
| 6,386,288 | B1 | 5/2002 | Snider et al. | |
| 6,494,261 | B1 | 12/2002 | Pahmiyer | |
| 6,536,524 | B1 | 3/2003 | Snider | |
| 6,557,636 | B2 * | 5/2003 | Cernocky et al. | 166/297 |
| 6,575,245 | B2 | 6/2003 | Hurst | |
| 6,584,406 | B1 | 6/2003 | Harmon et al. | |
| 6,695,054 | B2 | 2/2004 | Johnson | |
| 6,848,510 | B2 | 2/2005 | Bixenman | |
| 6,885,918 | B2 | 4/2005 | Harmon et al. | |
| 6,962,202 | B2 * | 11/2005 | Bell et al. | 166/297 |
| 7,131,494 | B2 | 11/2006 | Bixenman | |
| 7,278,484 | B2 | 10/2007 | Vella et al. | |
| 2001/0027864 | A1 * | 10/2001 | Vaynshteyn | 166/250.01 |
| 2001/0045281 | A1 * | 11/2001 | Foster et al. | 166/278 |
| 2002/0020535 | A1 | 2/2002 | Johnson | |
| 2002/0088620 | A1 | 7/2002 | Lerche et al. | |
| 2002/0092649 | A1 | 7/2002 | Bixenman | |
| 2002/0125011 | A1 | 9/2002 | Snider et al. | |
| 2002/0157829 | A1 | 10/2002 | Davis et al. | |
| 2003/0000411 | A1 | 1/2003 | Cernocky et al. | |
| 2003/0001753 | A1 | 1/2003 | Cernocky et al. | |
| 2003/0098157 | A1 | 5/2003 | Hales et al. | |
| 2003/0106697 | A1 | 6/2003 | Bode | |
| 2003/0230406 | A1 | 12/2003 | Lund | |
| 2004/0107825 | A1 | 6/2004 | Kash | |
| 2004/0159432 | A1 | 8/2004 | Johnson et al. | |
| 2004/0188093 | A1 | 9/2004 | Funchess | |
| 2004/0251024 | A1 | 12/2004 | Jones | |
| 2004/0251033 | A1 | 12/2004 | Cameron et al. | |
| 2005/0109508 | A1 | 5/2005 | Vella | |
| 2007/0044964 | A1 | 3/2007 | Grigar et al. | |

FOREIGN PATENT DOCUMENTS

| | | | |
|---|---|---|---|
| EP | 0288237 | A2 | 10/1988 |
| EP | 0628699 | | 12/1993 |
| EP | 0628699 | A1 | 12/1994 |
| GB | 2296925 | A | 4/1995 |
| GB | 2296924 | | 4/1997 |
| GB | 2297107 | | 4/1997 |
| GB | 2352261 | | 1/2001 |
| GB | 2397594 | | 7/2004 |
| GB | 2397594 | A | 7/2004 |
| GB | 2395962 | | 9/2004 |
| WO | WO 9517577 | | 6/1995 |
| WO | WO 0065195 | | 11/2000 |
| WO | WO 0302849 | | 1/2003 |
| WO | WO 9509965 | | 4/2005 |
| WO | WO 9509966 | | 4/2005 |
| WO | WO 9509967 | | 4/2005 |
| WO | WO 9509968 | | 4/2005 |

* cited by examiner

TECHNIQUE AND APPARATUS FOR MULTIPLE ZONE PERFORATING

This application is a continuation-in-part of U.S. patent application Ser. No. 10/686,043, entitled, "Techniques And Systems Associated With Perforation And The Installation Of Downhole Tools", filed on Oct. 15, 2003, which claims priority under 35 U.S.C. § 119 to U.S. Provisional Patent Application Ser. No. 60/419,718, filed on Oct. 18, 2002.

BACKGROUND

The invention generally relates to a technique and apparatus for multiple zone perforating.

A typical subterranean well includes multiple production zones. In the production of well fluid from these zones, the well fluid from the zones may be commingled; or alternatively, the zones may be isolated and produced separately. For the latter type of production, the zones may be initially isolated with packers and then perforated to prepare the zones for production.

Conventional systems to produce from multiple isolated zones use multiple strings to regulate and/or shut off the flows from the zones. As a more specific example, FIG. 1 depicts a conventional system 5 for completing and producing well fluid from two isolated production zones. As depicted in FIG. 1, a production string 10 (often called the "long string") extends into the interior of a casing string 8 of the well. During production from the well, the production string 10 communicates fluid from a lower production zone (not depicted in FIG. 1) that is located below a lower packer 16 to the surface of the well. The system 5 also includes another production string 12 (often called the "short string") that extends into the well beside the production string 10 and into an upper production zone 15 that is isolated between an upper packer 14 and the lower packer 16. Therefore, as depicted in FIG. 1, both production strings 10 and 12 extend through the upper packer 14.

Unlike the production string 10, the production string 12 does not extend through the packer 16. Instead, the production string 12 has a lower end 30 to receive well fluid from the production zone 15. As depicted in FIG. 1, the production string 12 may include a flow control device 32 for purposes of regulating and/or shutting off flow from zone 15.

For purposes of preparing the zone 15 for production, the well casing 8 and surrounding formation inside the zone typically are perforated using a perforating gun 22 that is eccentric to and clamped to the production string 10. More specifically, the production string 10 may include a Y-block gun hanger 20 for purposes of hanging the perforating gun 22 below the hanger 20, and the hanger 20 may include blast joints (larger outside diameter tubing) to protect the integrity of the production string 10. The perforating gun 22 extends beside and is coupled to (via clamps, such as a depicted clamp 23) section 25 of the production string 10. The production string 10 may include a guide nose 26 for purposes of connecting the perforating gun 22 and guiding the perforating gun 22 into the well.

A potential drawback with the system 5 is that the size of the perforating gun 22 is limited. More particularly, as can be seen from FIG. 1, inside the zone 15, the production string section 25 and perforating gun 22 span across the interior diameter of the casing string 8, thereby restricting the overall available outer diameter for the perforating gun 22. Another potential drawback with the system 5 is that the perforating gun 22 does not produce perforations that extend completely around the casing string 8. The limited perforating angle is due to the fact that the perforating charges of the gun 22 are directed away from section 25 of the production string 10 for purposes of avoiding damage to the production section 25. Therefore, the fluid carrying section 25 resides in a wedge that is excluded from the perforating charge phasing pattern of the perforating gun 22.

Thus, there exists a continuing need for a perforating/completion system that addresses one or more of the problems that are set forth above as well as potentially addresses one or more problems that are not set forth above.

SUMMARY

In an embodiment of the invention, a system that is usable with a well includes a first production string, a second production string and at least one isolation device to establish first and second isolated zones in the well. The first production string is adapted to extend through the first isolated zone to the second isolated zone. The first production string includes a perforating gun that is integral with the first production string and is adapted to fire inside the first isolated zone; and the first production string is further adapted to communicate well fluid from the second isolated zone after the perforating gun fires. The second production string extends into the first isolated zone to communicate well fluid from the first isolated zone.

In another embodiment of the invention, a technique that is usable with a well includes running a production string into the well so that the production string extends through a first isolated zone of the well and into at least a second isolated zone that is located farther into the well than the first isolated zone. The production string includes integrated perforating charges. The technique includes firing the perforating charges inside the first zone; and after the firing, maintaining a fluid isolation between the first isolated zone and a passageway of the production string. The passageway is used to communicate well fluid from the second isolated zone.

In another embodiment of the invention, an apparatus that is usable with a well includes perforating charges that are mounted to a production tubing. The perforating charges extend at least partially around a longitudinal axis of the tubing along an arcuate path that has a center that substantially coincides with a longitudinal axis of the tubing. The tubing includes a housing to isolate an internal passageway of the tubing from a region outside of the tubing after the perforating charges fire.

In yet another embodiment of the invention, a technique that is usable with a well includes establishing a first isolated zone in the well and a second isolated zone that is located farther downhole in the well than the first isolated zone. The technique includes running a first production string into the well so that the first production string extends through the first isolated zone and at least partially extends into the second isolated zone. The first production string includes a perforating gun. The technique also includes running a second production string into the well so that the second production string at least partially extends into the first isolated zone; and firing the perforating gun inside the first isolated zone. After the firing, the first production string communicates well fluid from the second isolated zone, and the second production string communicates well fluid from the first isolated zone.

Advantages and other features of the invention will become apparent from the following description, drawing and claims.

DETAILED DESCRIPTION

Figure 1:
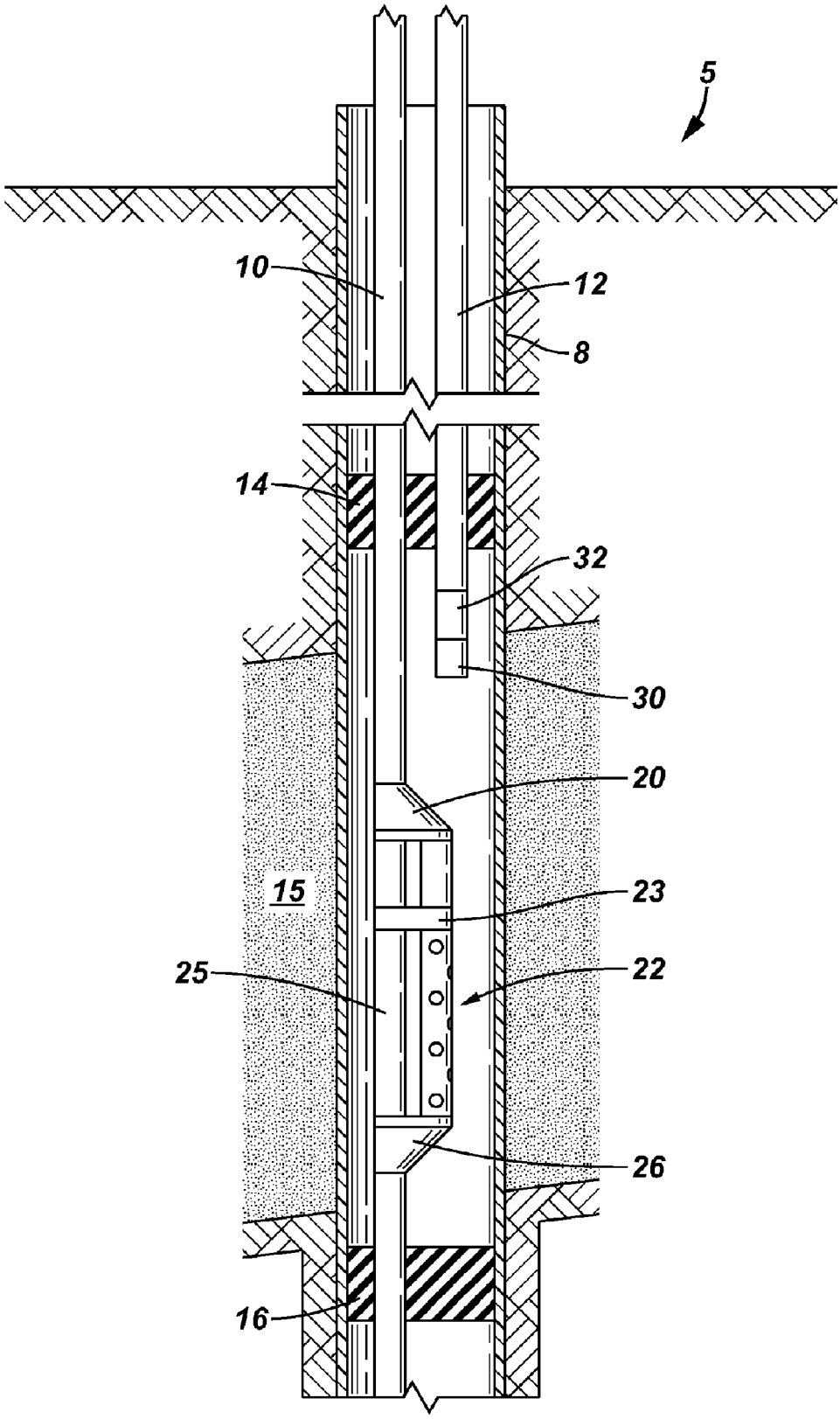
FIG. 1 (Prior Art)
FIG. 1 is a schematic diagram of a perforating/completion system of the prior art.
Figure 2:
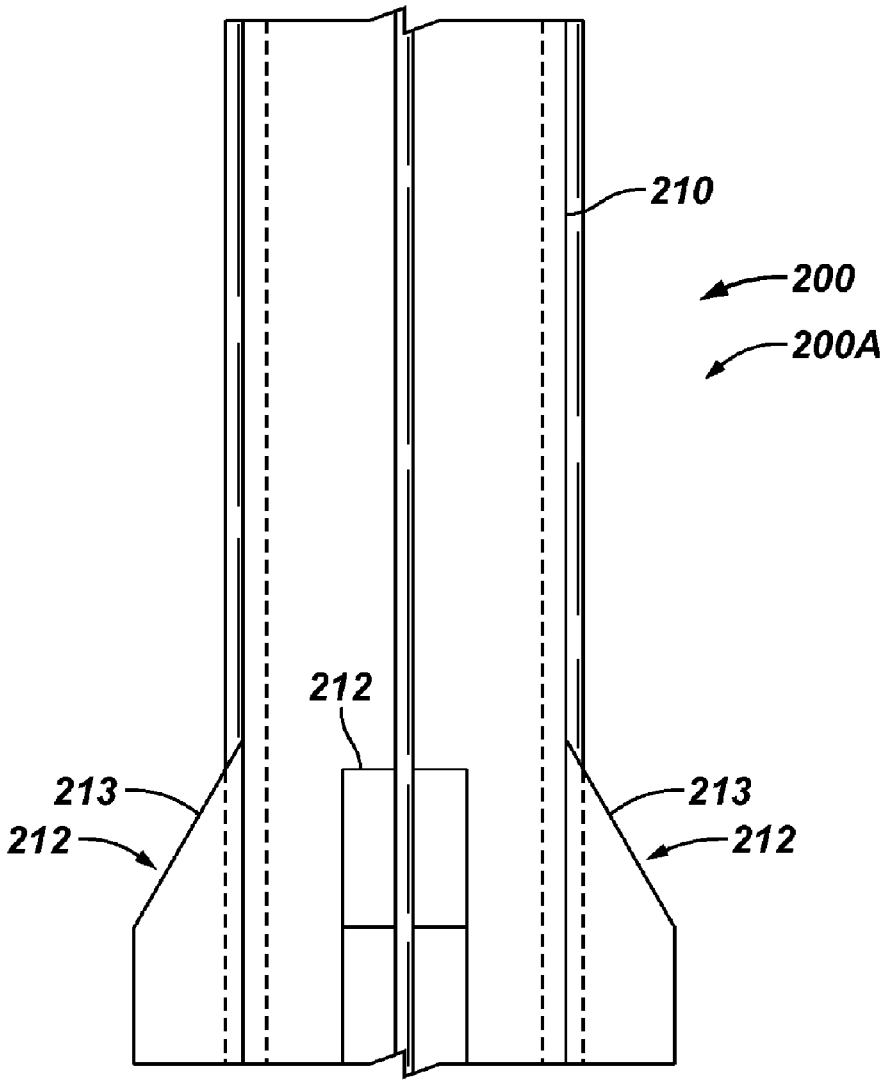
FIGS. 2, 3 and 4 depict a casing conveyed tool according to an embodiment of the invention.

Referring to FIGS. 2 (depicting an upper section 200A), 3 (depicting a middle section 200B) and 3 (depicting a lower section 200C), a casing conveyed perforating tool 200 may be installed in a casing string of a well for purposes of perforating the formation(s) of a selected zone to allow well fluid to be produced from that zone. It is noted that the casing conveyed perforating tool 200 does not restrict the inner diameter of the casing string, and various casing conveyed tools 200 may be located along the casing strings in the production zones to be produced. Thus, the isolation and perforation of multiple zones may be performed without clamping perforating guns to a production tubing string.

In some embodiments of the invention, the tool 200 includes a main casing body 210 that is generally a cylindrically shaped body with a central passageway therethrough. In some embodiments of the invention, the main casing body 210 may include threads (not shown) at its upper end for purposes of connecting the tool 200 to an adjacent upper casing section or another casing conveyed perforating tool. The main casing body 210 may also include may include threads (not shown) at its lower end for purposes of connecting the tool 200 to an adjacent lower casing section or another casing conveyed perforating tool. Thus, the tool 200 may function as a casing string section, as the tool 200 may be connected in line with a casing string, in some embodiments of the invention.

The tool 200 includes fins 212 that extend along the longitudinal axis of the tool and radially extend away from the main casing body 210. In addition to receiving perforating charges (shaped charges, for example), as described below, the fins 212 form stabilizers for the tool 200 and for the casing string. Each fin 212 may include an upper beveled face 213 (FIG. 23) and a lower beveled face 215 for purposes of guiding the tool 200 through the wellbore. A perspective view of the main casing body 210 and fins 212 is shown in FIG. 7.

Figure 3:
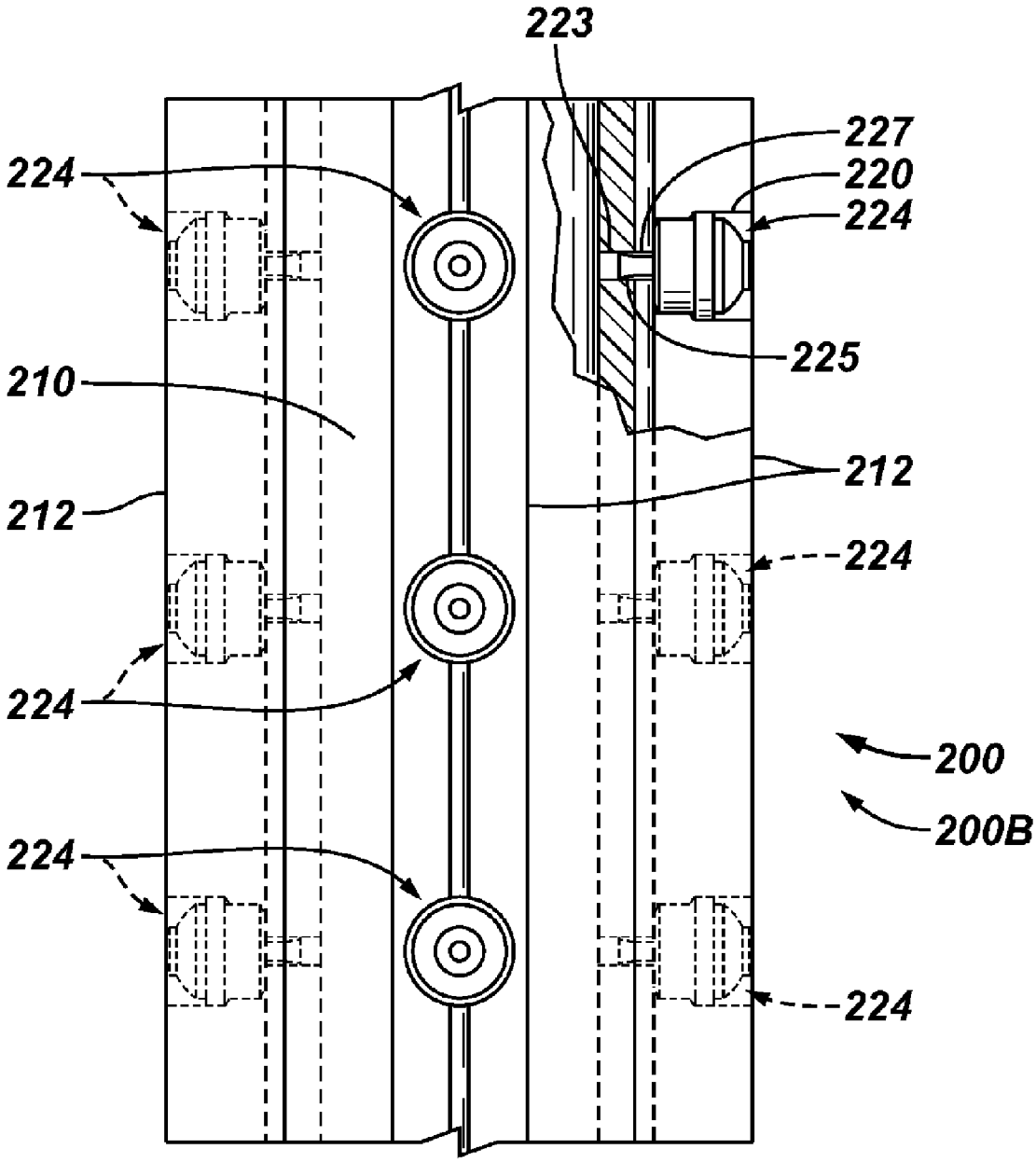
Figure 7:
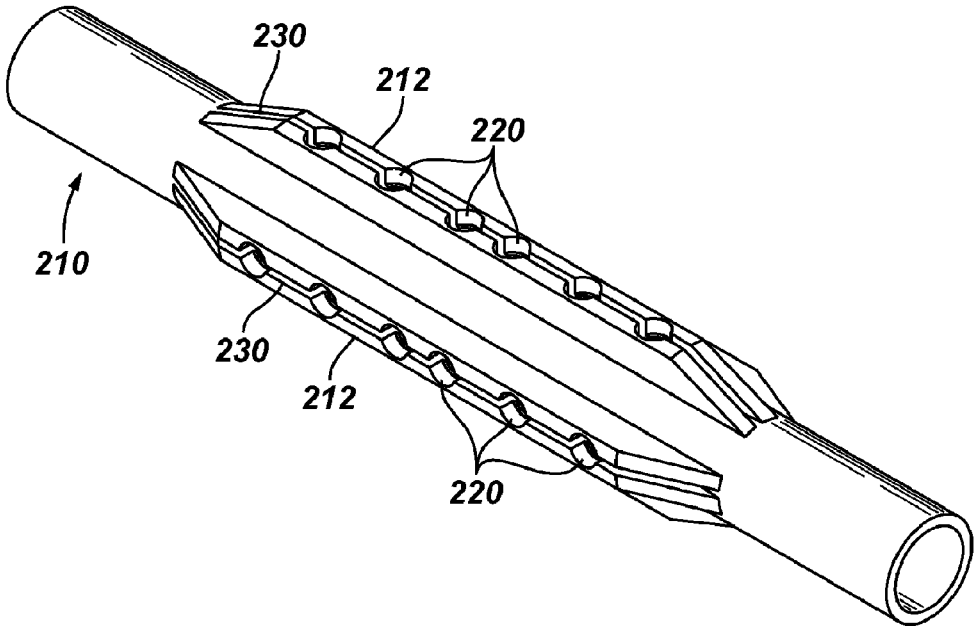
FIG. 7 depicts a main body of the casing according to an embodiment of the invention.

As depicted in FIG. 7, each fin 212 includes several openings 220 (see also FIG. 7), each of which extends radially away from the longitudinal axis of the tool 200 and receives a particular perforating charge 224. Each perforating charge 224 is oriented so that the perforating charge 224 generates a perforating jet in a radial direction into the surrounding formation. In the embodiment depicted in FIGS. 2-4, the perforating charges are arranged so that four perforating charges are contained in a plane (i.e., the perforating charges of each plane are oriented 90° apart). However, in other embodiments of the invention, the perforating charges 224 may be spirally arranged around the circumference of the casing body 210 to achieve a spiral phasing for the tool 200. In these embodiments of the invention, the openings 220 may be spaced to achieve the spiral phasing. In some embodiments of the invention, the fins 212 may helically extend around the main casing body 210 to achieve the spiral phasing. Many other variations for gun phasing, fin orientation and shaped charge orientation are possible and are within the scope of the appended claims.

Each perforating charge 224 is directed in a radially outward direction from the longitudinal axis of the tool 20 so that when the perforating charge 224 fires, the charge 224 forms a perforation jet that is radially directed into the surrounding formation. Initially, before any perforating charges 224 fire, the tool 200 functions as a typical casing section in that there is no communication of well fluid through the casing wall between the annulus and the central passageway. As described below, the firing of the perforating charges 224 produce communication paths between the tunnels formed by the charges 224 and the central passageway of the tool 200.

Referring to FIG. 7, each fin 212 includes a groove 230 that extends along the longitudinal axis of the casing and intersects each one of the openings 220 of the fin 212. This groove 230 may be used for purposes of routing a detonating cord (not shown in FIG. 7) to each of the perforating charges 220.

Figure 4:
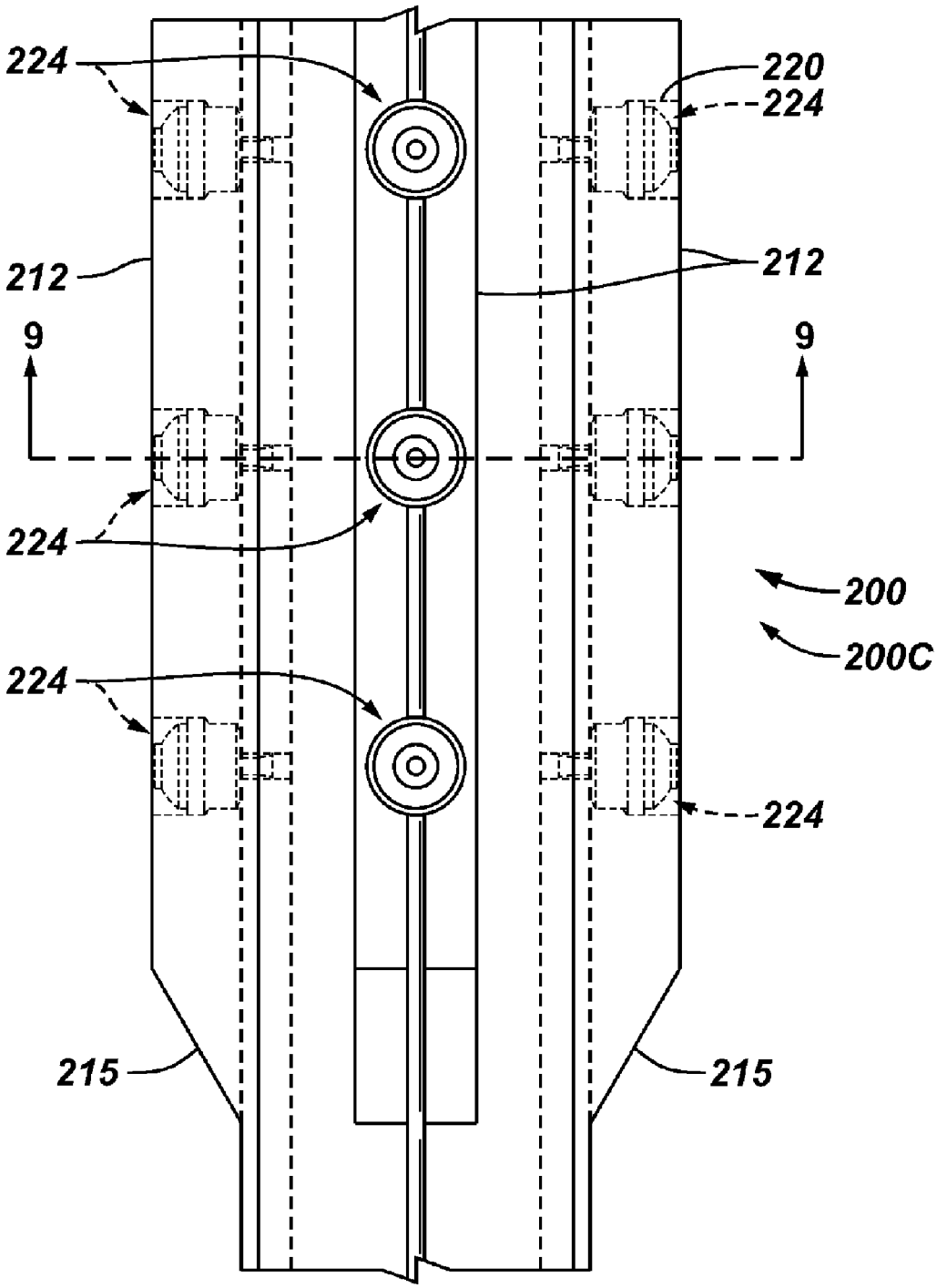
Figure 5:
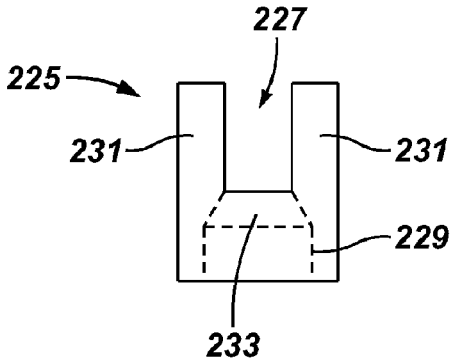
FIG. 5 is a side view of a plug of the tool of FIGS. 2, 3 and 4 according to an embodiment of the invention.
Figure 9:
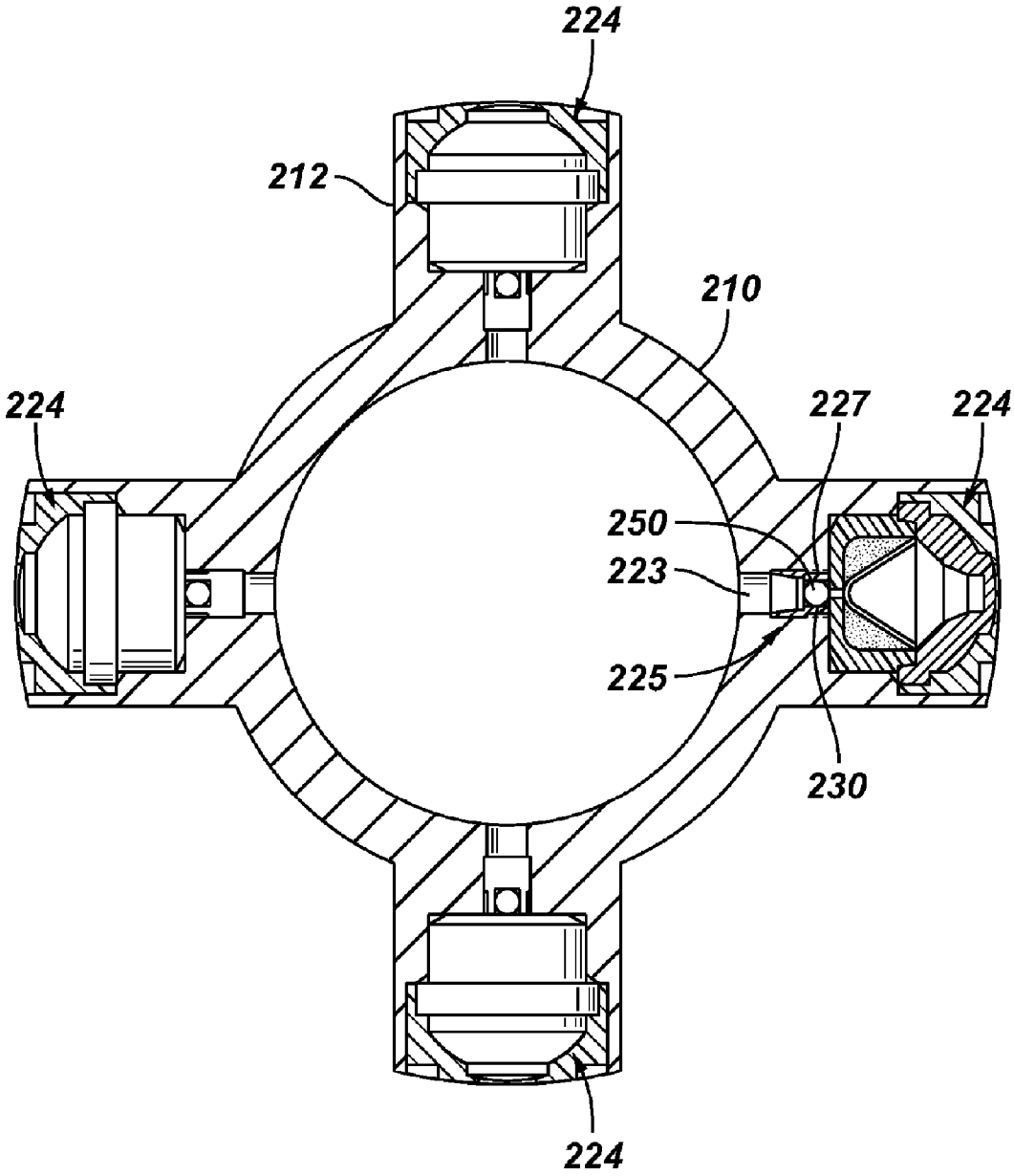
FIG. 9 depicts a cross-sectional view of the casing taking along line 9-9 of FIG. 4 according to an embodiment of the invention.

FIG. 9 depicts a cross-section of the tool 200, in accordance with some embodiments of the invention, taken along line 9-9 of FIG. 4. As shown, each perforating charge 224 is radially disposed so that the perforation jet formed from the perforating charge 224 extends in a radial direction away from the longitudinal axis of the casing. For each perforating charge 224, the main casing body 210 includes an opening 223 that radially extends between the central passageway of the tool 200 and the opening 220 (in the fin 212) that receives the perforating charge 224. Before the perforating charge 224 fires, a plug 225 is received in the opening 223 so that the passageway wall that defines the opening 223 forms a friction fit with the plug 225.

Figure 6:
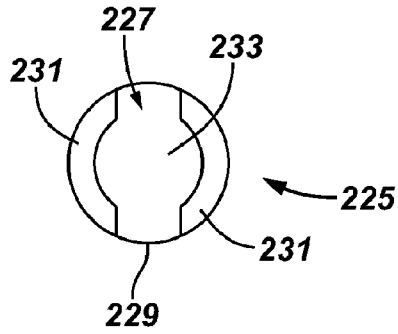
FIG. 6 is a top view of the plug according to an embodiment of the invention.

The presence of the plug 225 seals off the opening 223 so that during cementing through the central passageway of the tool 200, the cement does not enter the opening 223 and affect later operation of the perforating charge 224. Referring also to FIGS. 6 (a top view of the plug 225) and 5 (a side view of the plug 225), in some embodiments of the invention, the plug 225 includes side walls 231 that form a slot 227 to receive a detonating cord 250 that is received in the groove 230 (see also FIG. 7). The side walls 231 extend from a cylindrical base, a portion of which forms a rupture disk 233. The rupture disk 233 contacts the detonating cord 250. Therefore, when a detonation wave propagates along the detonating cord 250, the detonation wave serves the dual function of rupturing the rupture disk 233 and firing the perforating charge.

Thus, the firing of each perforating charge 224 creates a tunnel into the formation and an opening through what remains of the perforating charge 224. The rupturing of the rupture disk 233 creates an opening through the plug 225 to establish well fluid communication between the formation and central passageway of the tool 200 via the opening 233.

Therefore, after the perforating charges 224 of the tool 200 fire, the tool 200 transitions into a production casing, in that well fluid is produced through the openings 233.

Figure 8:
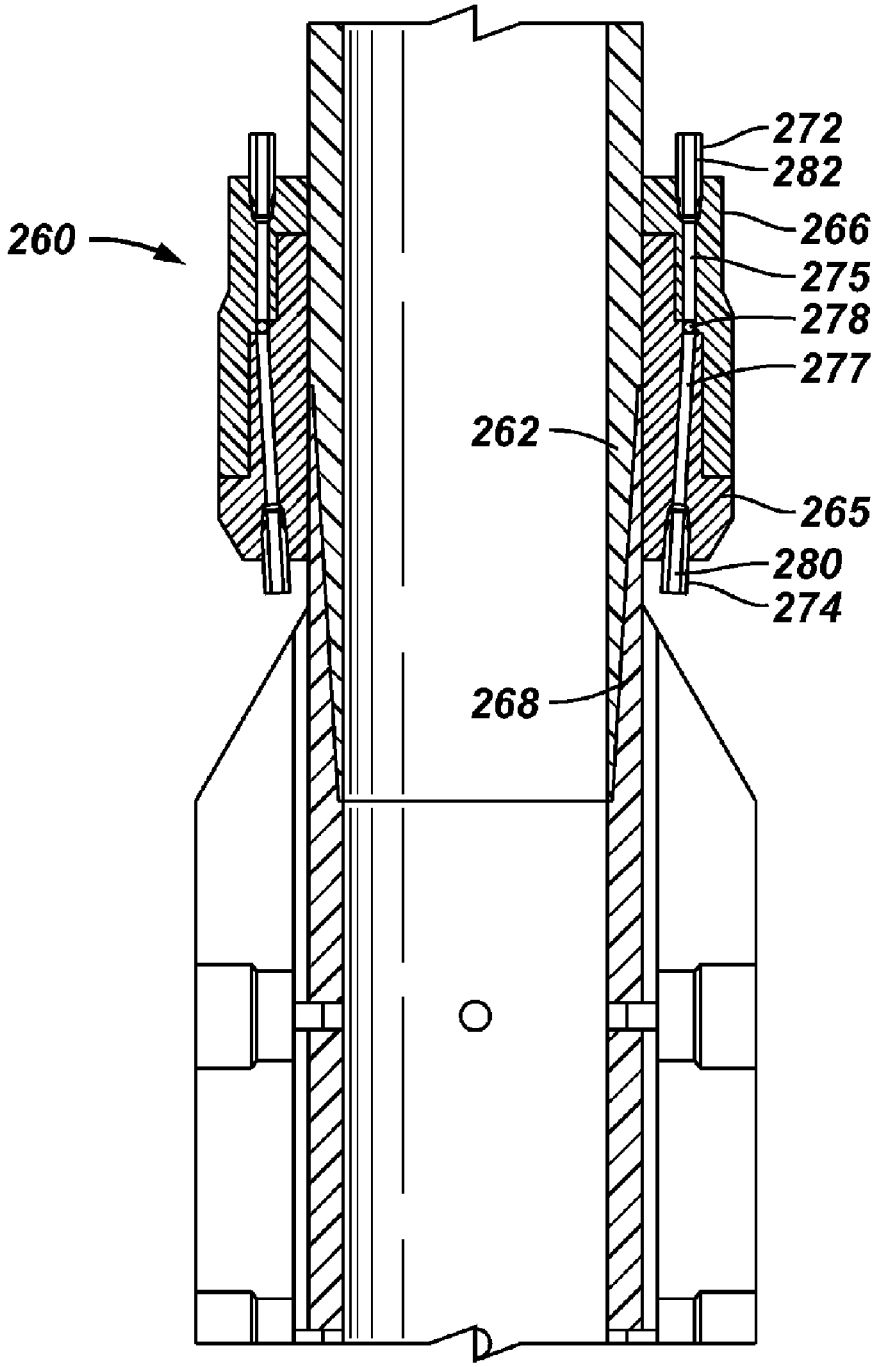
FIG. 8 depicts a ballistic junction according to an embodiment of the invention.

Referring to FIG. 8, in some embodiments of the invention, the tool 200 may be ballistically connected to an adjacent tool via a ballistic junction 260. In the embodiment depicted in FIG. 8, the junction 260 is attached to a lower end 262 of a particular tool 200 and located near an upper end 268 of an adjacent tool 200. The lower 262 and upper 268 ends may be threadably connected together for purposes of attaching the two tools 200 together.

The ballistic junction 260 includes an inner collar 265 that is attached (via threads or welds, for example) to the lower end 262 of the upper tool 200. An outer collar 266 is threaded onto the inner collar 265. The ballistic junction 260 has the following structure for each detonating cord that is longitudinally coupled through the junction 2604. The structure includes an opening in inner collar 265, an opening that receives a hydraulic seal fitting nut 274. The nut 274 receives and secures a lower detonator 280 to the inner collar 265. The lower detonator 280, in turn, is connected to a detonating cord that extends from the detonator 280 into one of the fins 212 of the lower tool 200. The outer collar 266 includes an outer collar 266 that receives a hydraulic seal fitting nut 272. The nut 272 receives and secures an upper detonator 282 to the outer collar 266. The upper detonator 282, in turn, is connected to a jumper detonating cord that extends from the detonator 282 into one of the fins 212 of the upper tool 200. The jumper detonating cords make the ballistic connection across the threaded casing joint, and are installed after the casing joint is made up, in some embodiments of the invention.

For each detonating cord that is longitudinally coupled through the junction 260, the ballistic junction 260 includes a detonating cord 277 that longitudinally extends from the lower detonator 274 to a detonating cord 278; and a detonating cord 275 that longitudinally extends from the upper detonator 272 to the detonating cord 278. Thus, due to this arrangement, a detonation wave propagating along either detonating cord 275 or 277 is relayed to the other cord. The detonating cord 278 extends circumferentially around the tool 200 and serves as a redundant detonating cord to ensure that an incoming detonation received on one side of the junction 160 is relayed to all detonating cords on the other side of the ballistic junction 160.

Figure 10:
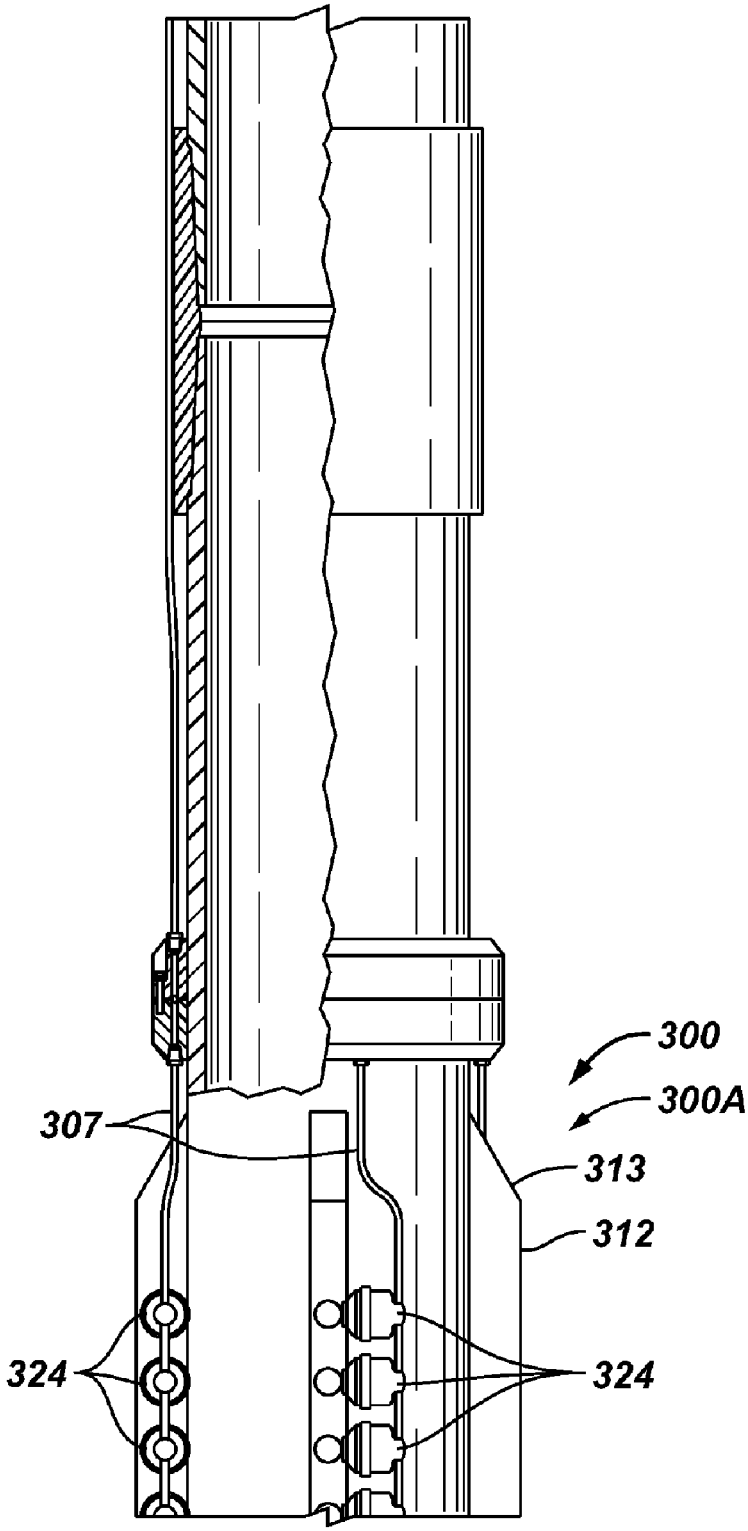
FIGS. 10 and 11 depict a casing conveyed tool according to another embodiment of the invention.
Figure 11:
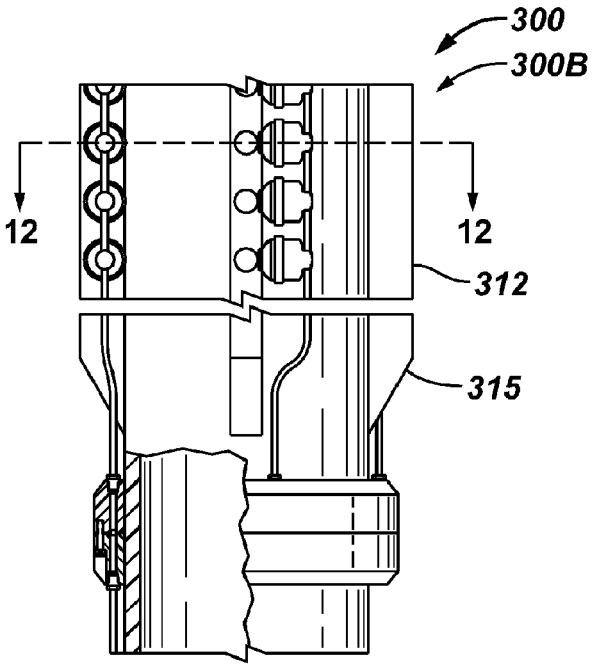

Other variations are possible for the casing conveyed perforating tool. For example, FIGS. 10 and 11 depict upper 300A and lower 300B sections of another perforating tool 300 in accordance with the invention. Unlike the casing conveyed perforating tool 200, the tool 300 includes perforating charges 324 (shaped charges, for example) that are oriented to fire tangentially to the longitudinal axis of the tool 300. This is in contrast to the tool 200 in which the perforating charges fire radially with respect to the longitudinal axis of the tool 200.

As depicted in FIGS. 10 and 11, each perforating charge 324 is connected to the side wall of a corresponding fin 312. Similar to the tool 200, the fins 312 serve as a stabilizer for the casing string. Furthermore, each fin 312 includes upper 313 and lower 315 beveled surfaces, similar to the tool 200.

Unlike the tool 200, the perforating charges 324 of the tool 300 are oriented so that the perforation jet from the perforating charges 324 are directed through the fin 312 to which the perforating charges 312 are attached. As depicted in FIGS. 10 and 11, the tool 300 includes detonating cords 307, each of which is associated with a particular fin 312. As shown, each detonating cord 307 is routed along a corresponding fin 312 and through the associated perforating charges 324 of the fin 312.

Figure 12:
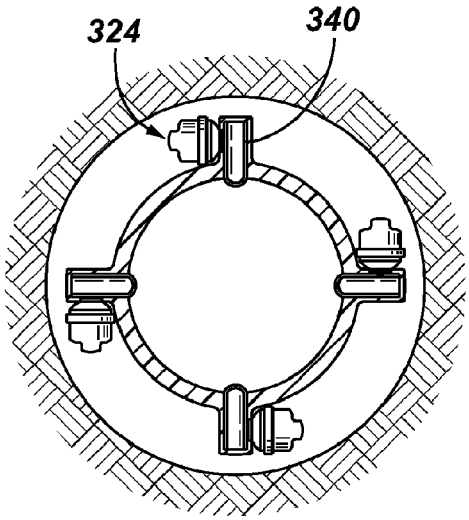
FIG. 12 is a cross-sectional view of the tool taken along line 12-12 of FIG. 11.

FIG. 12 depicts a cross-sectional view of the tool 300, taken along lines 12-12 of FIG. 11. As shown in this Figure, each fin 312 contains an internal passageway so that when the perforating charges 324 fire, communication is established through the fins 312 into the central passageway of the tool 300. For purposes of sealing off the internal passageways of the fins 312 before the firing of the perforating charges 324, the tool 300, in some embodiments of the invention, includes a knockout plug 340 for each associated perforating charge 324. The knockout plug 340 protrudes into the central passageway of the tool 300 so that a tool may be run downhole to break these plugs 340 after the perforating charges 324 fire. Similar to the tool 200, the tool 300 may include other features such as a ballistic junction 308, similar to the ballistic junction 260 discussed above.

In some embodiments of the invention, the tool 200 or 300 may include an orientation mechanism to allow the subsequent running of a gun string downhole inside the tool 200 or 300 in case the perforating charges of the tool do not fire. The orienting mechanism, as set forth below, ensures that the perforating charges of the subsequently run gun string are aligned between the fins of the tool 200 or 300. In other words, the perforating charges of this gun string are aligned to minimize the thickness of the casing through which the perforation jets are directed.

Figure 13:
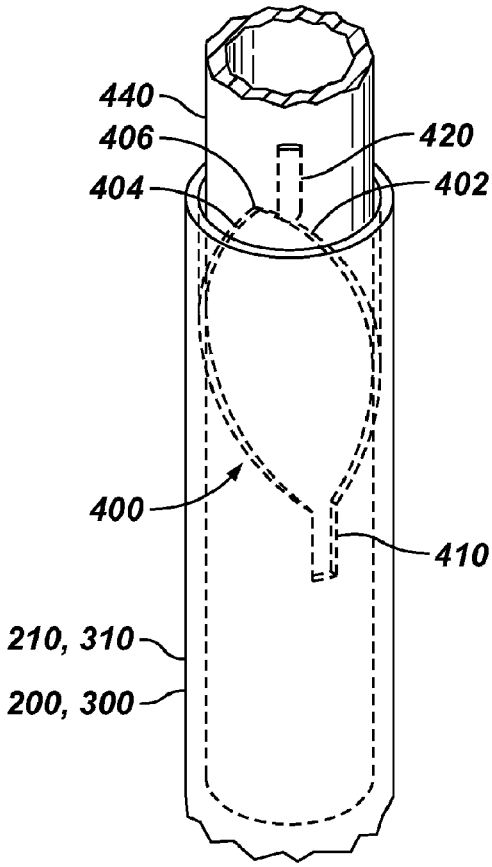
FIG. 13 is a perspective view of a gun locator mechanism according to an embodiment of the invention.

In some embodiments of the invention, this mechanism includes a key 420 on a subsequently run gun string 440. The mechanism ensures that the key 402 is aligned in a slot 410 so that when the key 420 is aligned in the slot 410, the perforating charges (not shown) of the gun string 440 perforate between the fins of the tool 200 and 300. The orienting mechanism includes an internal profile 400 located inside the main casing body 210, 310 of the tool 200, 300. The profile 400 is directed to interact with the key 420 to rotate the string 440 for purposes of aligning the key 420 in the slot 410. As depicted in FIG. 13, in some embodiments of the invention, the profile 400 may have a peak 406 located in a diametrically opposed position to the slot 410. The profile includes a first slope 404 that wraps around the interior of the gun string 440 toward the slot 410 in a first rotational direction and a slope 402 that wraps around the profile toward the slot 410 in an opposite rotational direction. Therefore, regardless of where the key 420 ends up on the profile 400, the key is always directed into the slot 410, and thus, the attached gun string 440 is rotated into the proper orientation for firing of its perforating charges. The key 420 must be aligned with the perforating charges in the secondary gun string (done at the surface).

Figure 14:
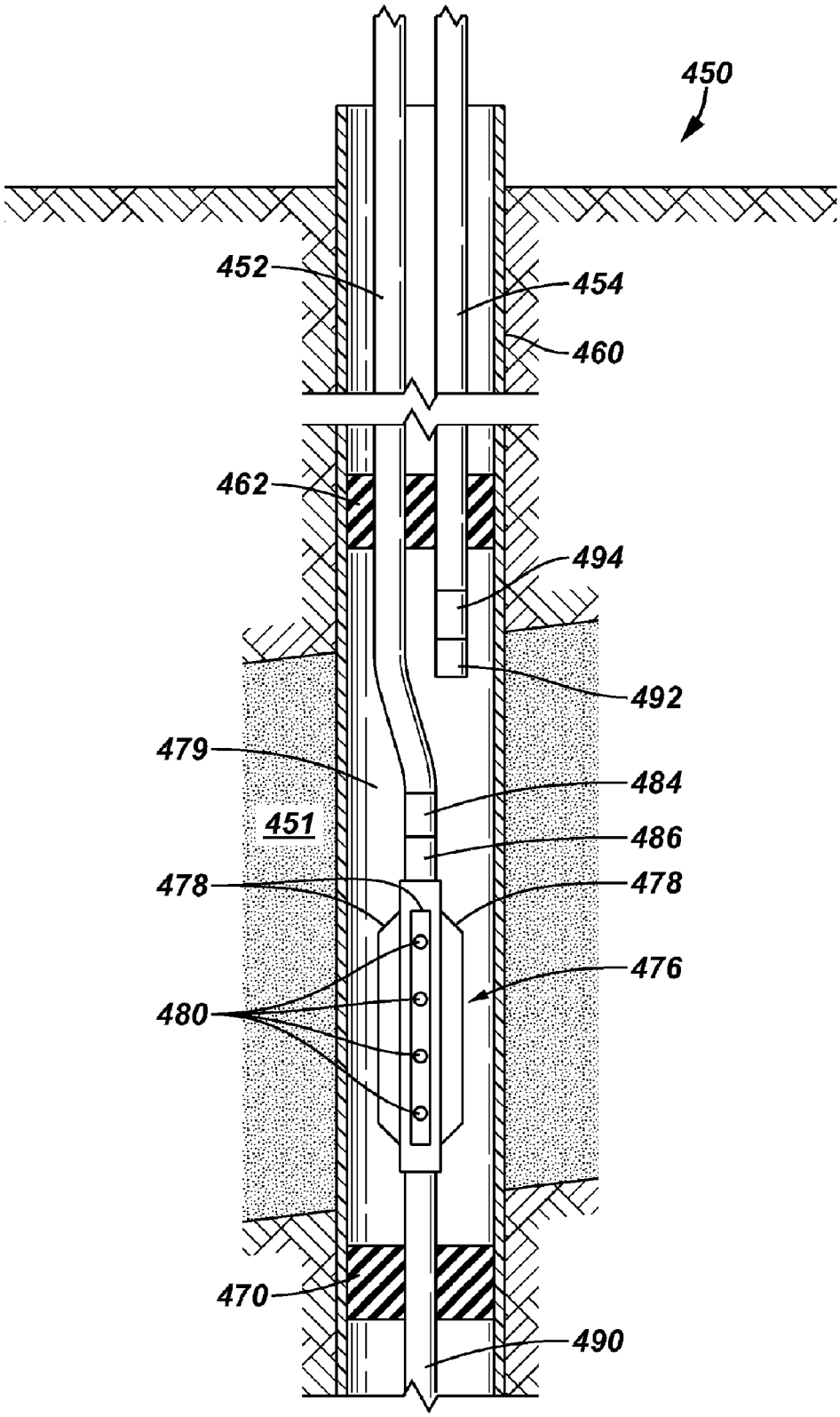
FIG. 14 is a schematic diagram of a perforating/completion system according to an embodiment of the invention.

Referring to FIG. 14, in accordance with some embodiments of the invention, in a perforating/completion system 460, a perforating gun 476 may be installed as part of a production string 452. The perforating gun 476, which may be viewed as a "production string perforating gun," is part of the production string 452. The perforating/completion system 450 produces well fluid from two isolated production zones. One of these production zones, a production zone 451, is depicted in FIG. 14. The production zone 451 is formed between an upper packer 462 (forming an upper annular seal) and a lower packer 470 (forming a lower annular seal). Similar to conventional dual isolated zone completions, the system 450 includes another production string 454 in conjunction with the production string 452. However, unlike conventional perforation/completion systems, the perforating gun 476 is installed as part of the production string 452 and includes integrated and radially directed perforating charges 480 that may extend completely around the longitudinal axis of the perforating gun 476, in some embodiments of the invention.

More specifically, as further described below, in some embodiments of the invention, the perforating charges 480 are generally located along an arc path that has a center that coincides with the longitudinal axis of the perforating gun 476. In some embodiments of the invention, the arc path may extend 360° around the longitudinal axis of the perforating gun 476. As a more specific example, the perforating charges 480 may be arranged into four longitudinal groups that are spaced apart by 90° apart about the longitudinal axis of the perforating gun 476. Other phasing patterns and perforating charge groupings and shot densities (shots per foot) may be used in other embodiments of the invention, as further described below.

In some embodiments of the invention, the perforating charges 480 are incorporated into longitudinal fins 478 of the perforating gun 476 and surround the central passageway of the production string 452. As described further below, when the perforating charges 480 fire, none of the resulting perforating jets penetrate the wall of the production string 452. Thus, the perforating gun 476 forms perforation tunnels (not depicted in FIG. 14 due to the unfired state of the perforating gun 476) in a casing 460 and the surrounding formation(s) of the zone 451, while allowing well fluid to be subsequently produced through the production string 452 from another zone. This other zone, may, for example, reside below the zone 451; and as depicted in FIG. 14, a portion 490 of the production string 452 extends below the lower packer 470 into the other zone, in some embodiments of the invention.

In some embodiments of the invention, the production string 452 includes a firing head 484 for purposes of initiating detonation waves on detonating cords that extend to the perforating charges 480. The firing head 484 may be, for example, a hydraulic firing head, that may be run into the well as part of a stand alone configuration or part of a redundant firing head configuration. Furthermore, in some embodiments of the invention, the firing head 484 may be an inductive coupler firing head, a head that is activated by pressure that is communicated through the production string 454 into the zone 451.

Alternatively, in some embodiments of the invention, the firing head 484 may be an annular inductive coupler-type firing head that is mounted on the outside of the production string 452. In this regard, a male coil may be run inside the casing string 460 to the level of the firing head 484 on an electric wire line so that the male coil may be powered up through the electric wire line to fire the perforating charges 480. The male coil may also be powered up to start a delay in the firing head 484, for the scenario in which the firing head 486 is a hydraulic delay firing head. The delay permits the male coil and the electric wire line to be removed from the well before the perforating charges 480 fire. Alternatively, the male coil may be run on coiled tubing or a slickline and may be battery-powered. Thus, many variations are possible and are within the scope of the appended claims.

Among the other features of the production string 452, in some embodiments of the invention, the production string 452 may include a ballistic junction 486 for purposes of coupling the detonating cords to the perforating charges 480, similar to the ballistic junction that is discussed above in connection with the casing conveyed perforating tools. As depicted in FIG. 14, in some embodiments of the invention, the production string 452 is a "long string" that extends through and below the zone 451 into a lower isolated zone for purposes of communicating well fluid from this zone; and the production string 454 is a "short string" and extends only partially into the production zone 451 so that an end 492 of the string 454 is positioned to receive well fluid from the zone 451. The production string 454 may include a valve 492 (a ball valve or a sleeve valve, as just a few examples) for purposes of regulating as well as possibly shutting off the flow of well fluid between the zone 451 and the string 454.

Figure 15:
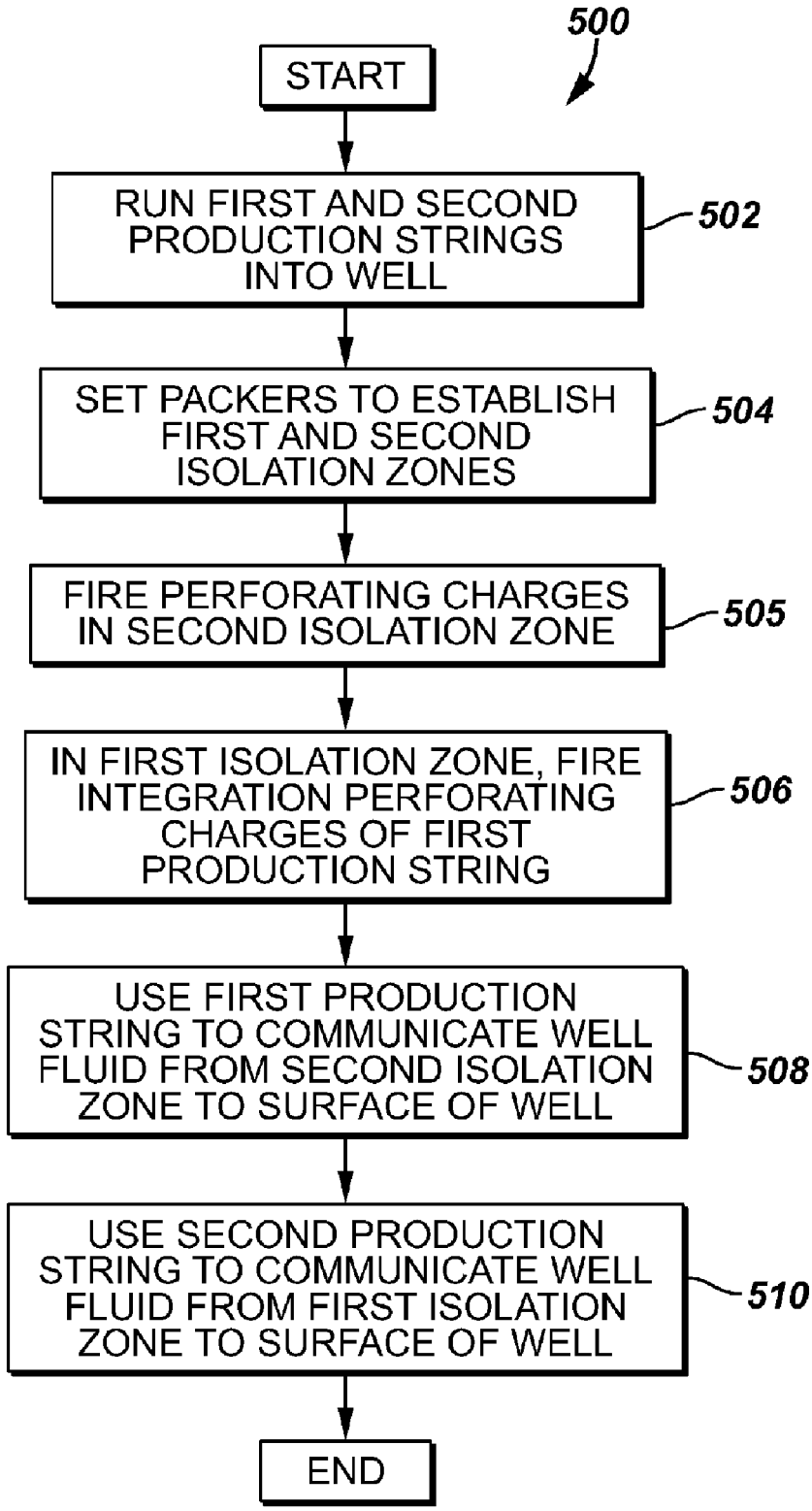
FIGS. 15 and 19 are flow diagrams depicting techniques to produce well fluid from two isolated production zones according to different embodiments of the invention.

Thus, a technique 500 that is depicted in FIG. 15 may be used for purposes of producing well fluid from dual isolated production zones in accordance with some embodiments of the invention. Pursuant to the technique 500, first and second production strings are run into the well, as depicted in block 502. Packers are then set (block 504) to establish first and second isolated zones. Subsequently, perforating charges are fired in the second isolated zone, pursuant to block 505. These perforating charges may be part of the first production string, in some embodiments of the invention. In the first isolated zone, integrated perforating charges of the first production string are fired, as depicted in block 506. The first production string is used (block 508) to communicate well fluid from the second isolated zone to the surface of the well which can be perforated before or after the first isolated zone. The second production string is used to communicate well fluid from the first isolated zone to the surface of the well, as depicted in block 510.

Figure 19:
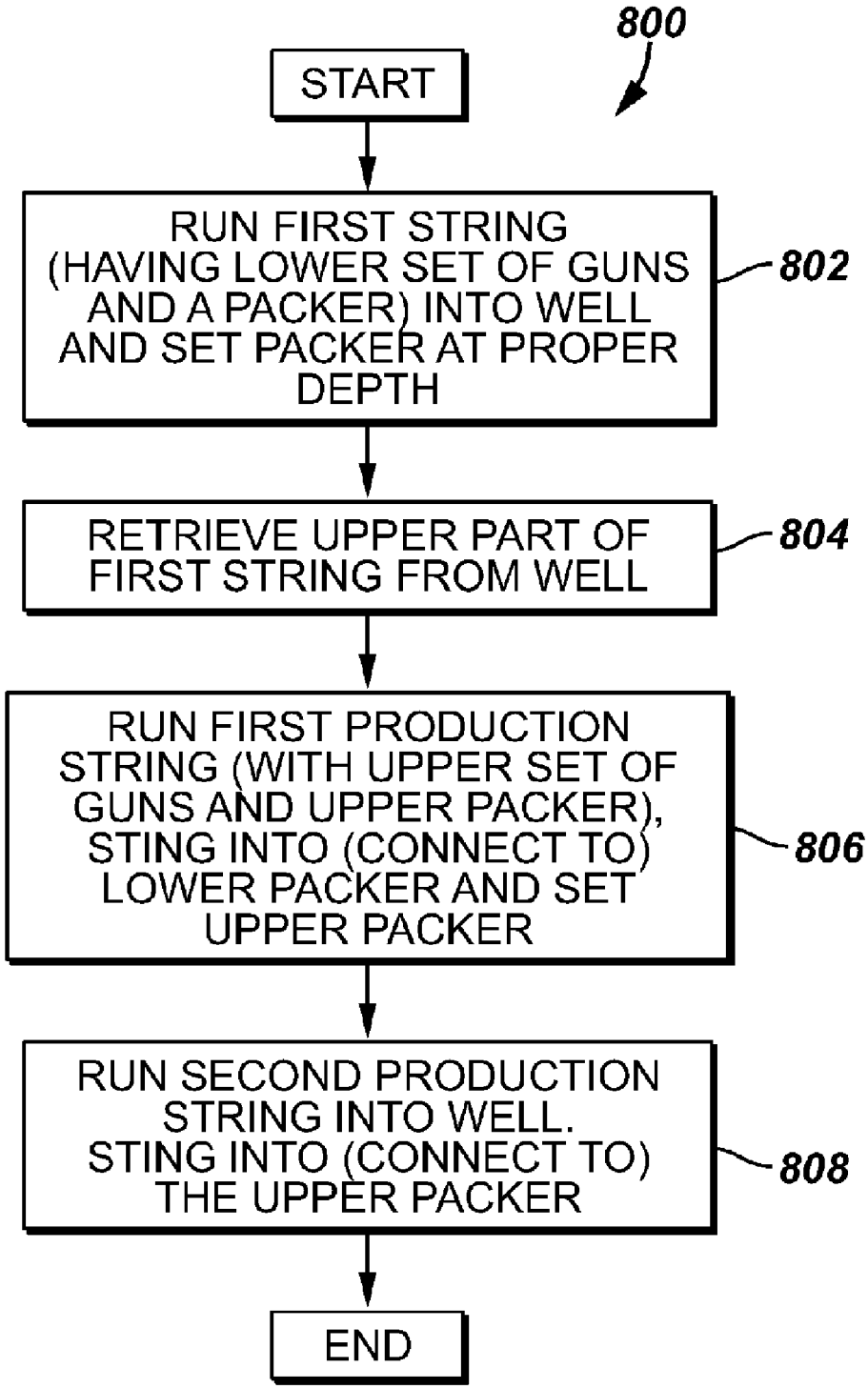

Referring to FIG. 19, alternatively, in another embodiment of the invention, a technique 800 may be used for purposes of producing well fluid from duel isolated production zones. In accordance with the technique 800, a first string having a lower set of guns is run into the well and a packer of the first string is set at the proper depth, as depicted in block 802. Next, an upper part of the first string is retrieved from the well, pursuant to block 804. Subsequently, a first production string is run into the well with an upper set of guns and an upper packer. This first production string stings into (i.e., connects to) a lower packer, and then the upper packer is set, in accordance with block 806. Finally, a second production string is run (block 808) into the well; and this second production string stings (i.e., connects to) the upper packer. Other variations are possible in other embodiments of the invention.

Figure 16:
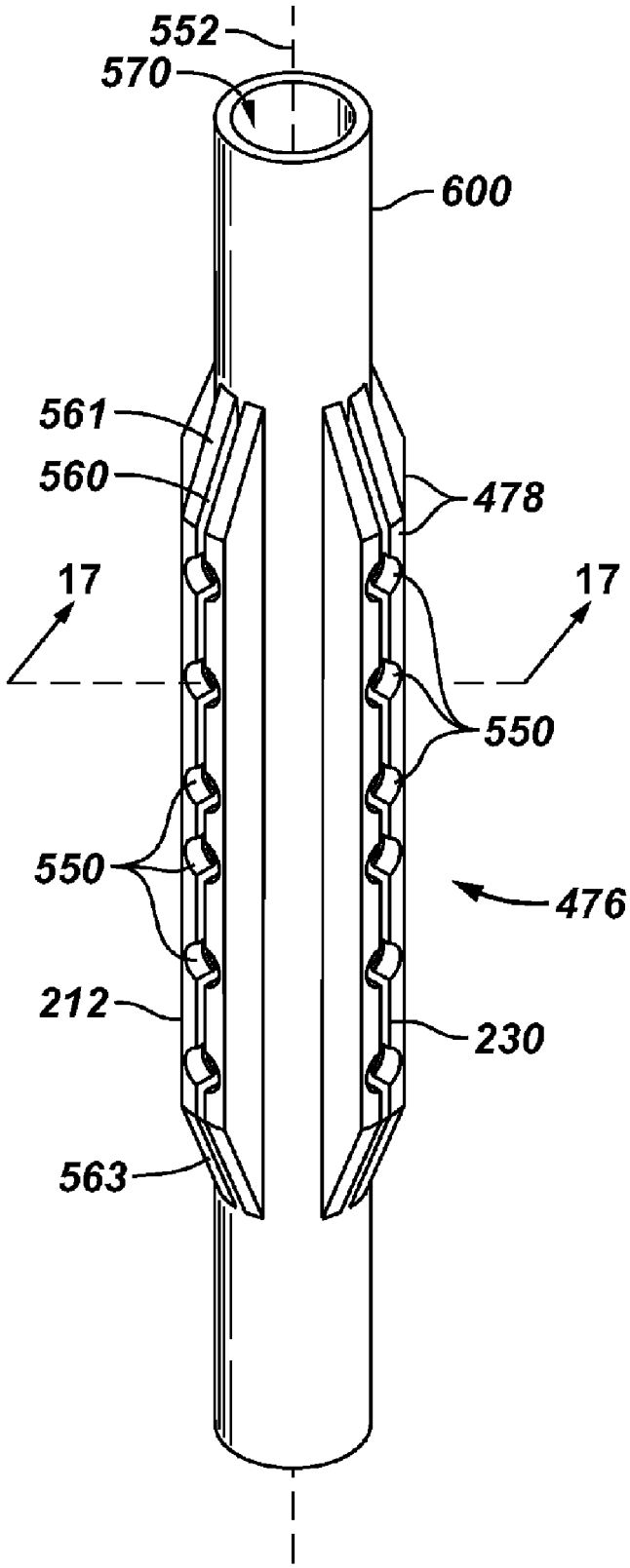
FIG. 16 is a perspective view of the production string-conveyed perforating gun of FIG. 14 according to an embodiment of the invention.

FIG. 16 depicts one out of many possible embodiments of the perforating gun 476 in accordance with the invention. The perforating charges 480 (see FIG. 14) for the perforating gun 476 are not depicted in FIG. 16. As shown in FIG. 16, the perforating gun 476 includes a housing that includes a generally cylindrical wall 600. The wall 600 generally circumscribes a longitudinal axis 552 (of the perforating gun 476) to form an internal central passageway 570 through the perforating gun 476. Each fin 478 extends in a radially outward direction from the exterior of the wall 600; and each fin 478 is parallel to the longitudinal axis 552. As depicted in FIG. 16, in some embodiments of the invention, the fins 478 are regularly-spaced about the longitudinal axis 552 (i.e., the same angle exists between each pair of adjacent fins 478). However, it is understood that the configuration/design of the perforating gun is not to be limited to the specific perforating gun 476 that is depicted in FIG. 16.

For example, in other embodiments of the invention, the perforating gun may include perforating charges that extend in a helical, or spiral, path around the longitudinal axis of the perforating gun. Therefore, in these embodiments of the invention, the perforating gun may have, for example, fins that extend in spiral patterns around the exterior of the perforating gun. As another example, in some embodiments of the invention, phasing angles other than the angles described above may be used in the perforating gun. Thus, many other variations are possible and are within the scope of the appended claims.

Referring back to the specific embodiment that is depicted in FIG. 16, each fin 478, in some embodiments of the invention, includes upper 561 and lower 563 inclined faces for purposes of facilitating the running of the perforating gun 476 into the well. Furthermore, in some embodiments of the invention, the fins 478 serve as stabilizers to centralize the position of the perforating gun 476 inside the casing string 108 (see FIG. 14).

As depicted in FIG. 16, each fin 478 may include a groove 560 or alternatively a hole that is generally parallel to the longitudinal axis 552 for purposes of holding a detonating cord for the perforating charges 480 (see FIG. 14) that are disposed in the fin 478. It is noted that the detonating cords from the fins 478 are coupled together above and possibly below the perforating gun 478 by ballistic junction(s) 486 (see FIG. 14), such as the ballistic junction that is described above in connection with the casing conveyed perforating tool.

The groove 560 extends through pockets 550 that are formed in the fin 478. Each pocket 550 is sized to receive a corresponding perforating charge 480 (see FIG. 14). As depicted in FIG. 16, for each fin 478, the corresponding pockets 550 are parallel to the longitudinal axis 552, although other orientations are possible in other embodiments of the invention.

Figure 17:
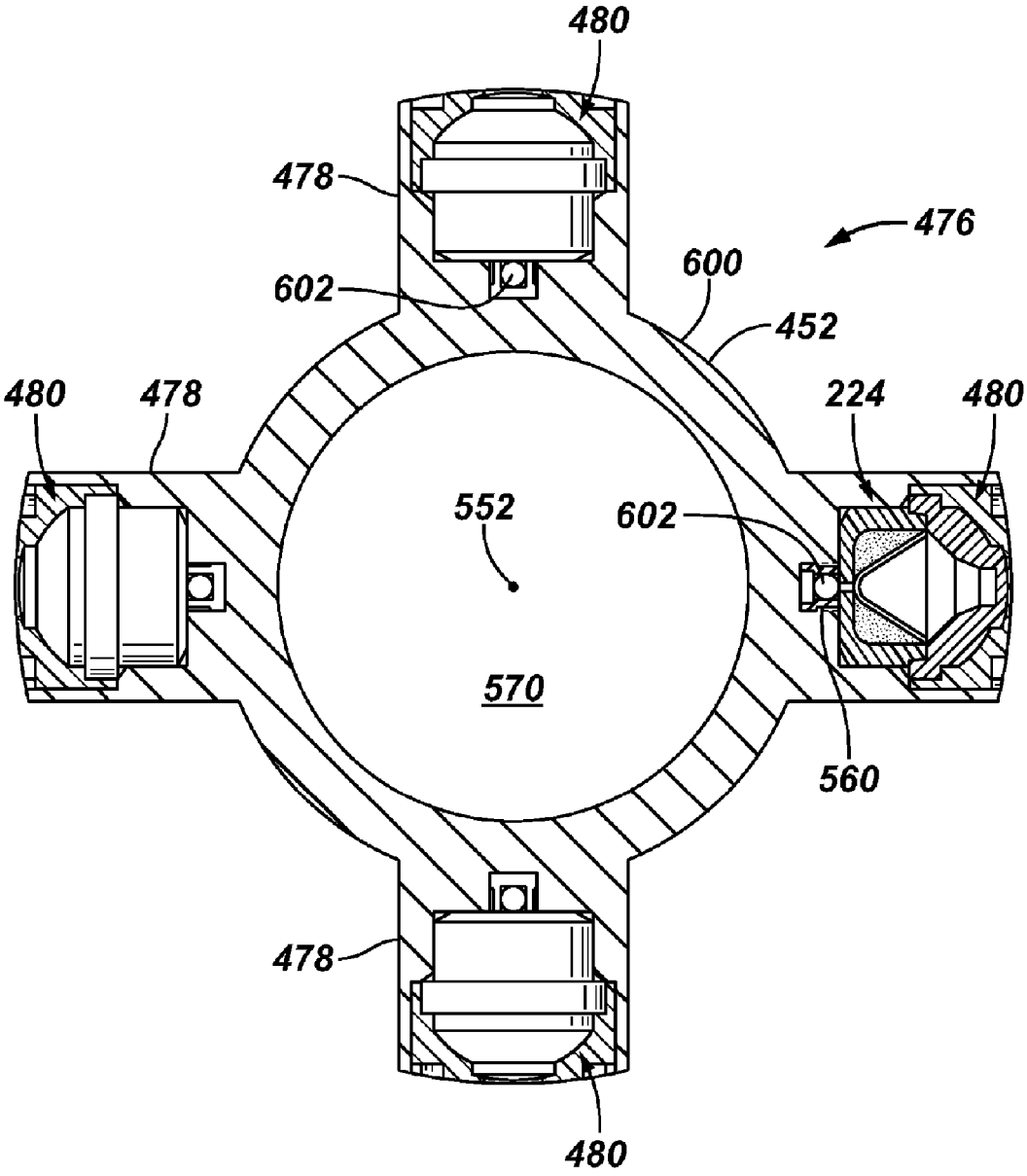
FIG. 17 is a cross-sectional view taken along line 17-17 of FIG. 16 according to an embodiment of the invention.

FIG. 17 depicts a cross-sectional view taken along line 17-17 of FIG. 16 when the perforating charges 480 (not depicted in FIG. 16) are mounted inside the pockets 550. Detonating cords 602 extend to the perforating charges 480; and as depicted in FIG. 17, the perforating charges 480 are oriented in radially outward directions to form corresponding radially-directed perforating jets when fired. The wall 600 of the perforating gun 476 has a sufficient thickness so that when the perforating charges 480 fire, no penetration of the wall 600 occurs to keep the central passageway 570 of the perforating gun 476 isolated from an annular region 479 (see FIG. 14) outside of the perforating gun 476. Thus, after firing of the perforating gun 476, well fluid may be communicated through the central passageway 570 of the perforating gun 476 to the surface of the well without commingling this well fluid with well fluid from the zone 451 (see FIG. 14).

Other embodiments are within the scope of the appended claims. For example, in other embodiments of the invention, slots may be formed in the fins of the perforating gun for purposes of accepting a strip-type perforating gun. Thus, each fin may contain, for example, a strip-type perforating gun, instead of the arrangement described above in which the perforating charges are directly disposed in the fin. Other arrangements and configurations are possible in other embodiments of the invention.

Figure 18:
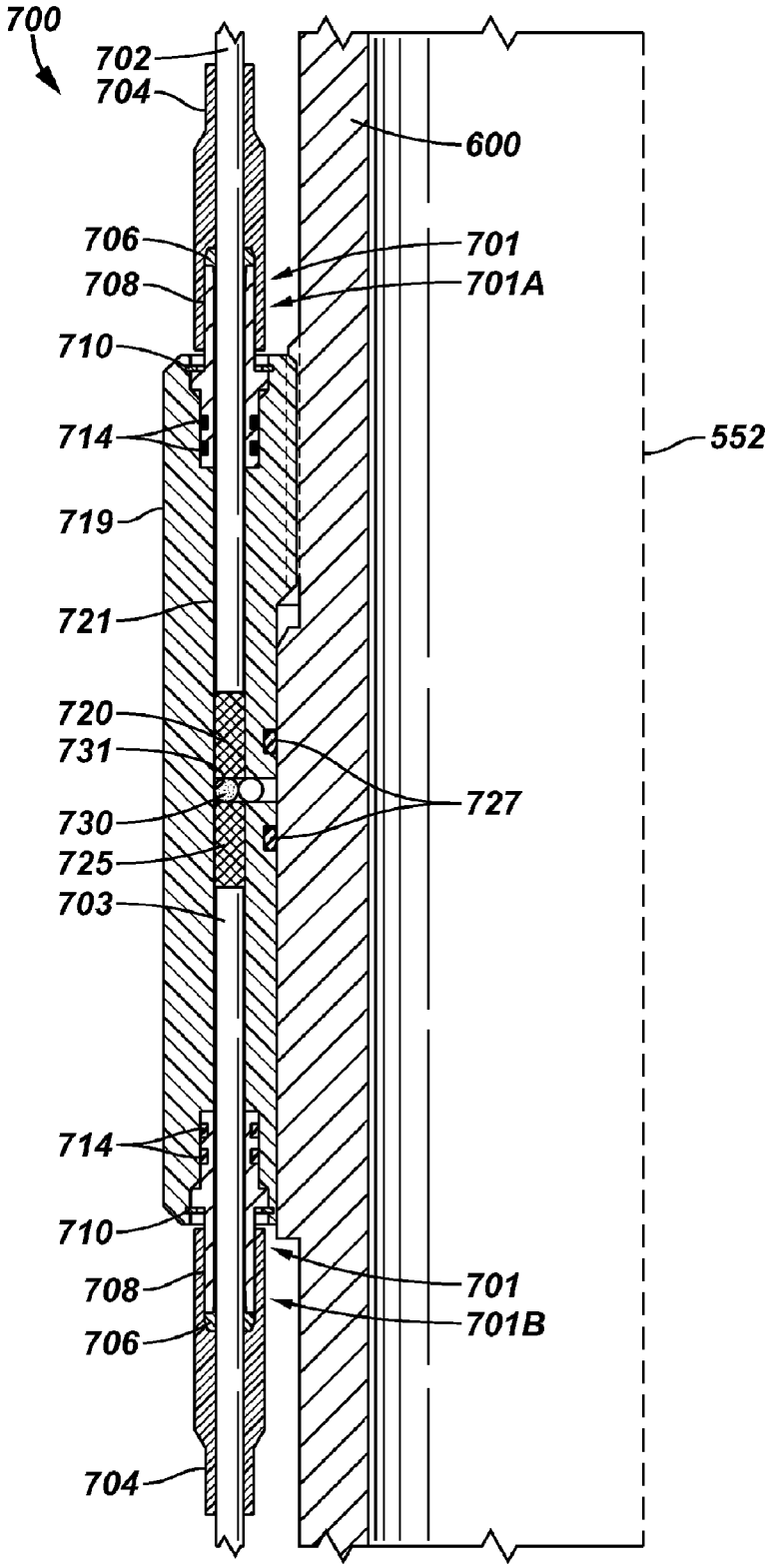
FIG. 18 depicts a ballistic junction according to an embodiment of the invention.

As an example of another embodiment of the invention, referring to FIG. 18, the ballistic junction 486 (see FIG. 14) may be replaced by a ballistic junction 700. The ballistic junction 700 includes a collar 719 that couples longitudinally-extending detonating cords (an upper detonating cord 702 and a lower detonating cord 703 being depicted in FIG. 18) to one or more detonating cords 730 that extend around the longitudinal axis 552. More specifically, in accordance with some embodiments of the invention, the collar 720 includes a longitudinal passageway 721 that receives the upper 702 and lower 703 detonating cords. The collar 719 generally circumscribes the wall 600 and is generally sealed to the wall 600 via O-rings 727. As depicted in FIG. 18, the O-rings 727 may be located on either side of an annularly-extending slot 731 that includes one or more radially-extending detonating cords 730, in some embodiments of the invention.

The lower end of the upper detonating cord 702 is attached to a booster 720 that contacts the detonating cord(s) 730. Similarly, the upper end of the lower detonating cord 703 is attached to a booster 725 that contacts the detonating cord(s) 730. The detonating cords 702 and 703 and the boosters 720 and 725 are held in the position that is depicted in FIG. 18 due to the connections of the upper 702 and lower 703 detonating cords to the collar 719 via connection assemblies 701A and 701B. More specifically, each connection assembly 701A, 701B, has a common design 701. The connection assembly 701A connects the upper detonating cord 702 to the collar 719; and the lower connection assembly 701B connects the lower detonating cord 703 to the lower end of the collar 719.

The connection assembly 701 includes a sealing tube 708 that resides in a recessed area of the collar 719 and is coaxial with the longitudinal passageway 721. The sealing tube 708 includes a passageway through which the detonating cord 702, 703 extends. As depicted in FIG. 18, in some embodiments of the invention, one or more O-rings 714 may form annular seals between the outer surface of the sealing tube 708 and the region of the collar 719 in which the sealing tube 708 resides. Furthermore, in accordance with some embodiments of the invention, a snap ring 710 may secure the sealing tube 708 to the collar 719. In some embodiments of the invention, the connection assembly 701 includes a crimp sleeve 706, a device that is compressed between the sealing tube 708 and the detonating cord 702, 703 for purposes of securing the detonating cord 701, 703 to the connection assembly 701.

Among the other features of the connection assembly 701, in some embodiments of the invention, a sealing boot 704 may form a general outer seal for the connection assembly 701. As depicted in FIG. 18, the sealing boot 704 is concentric with the connection assembly 701 and is designed to reside over the crimp sleeve 706 and sealing tube 708.

As yet another example of an additional embodiment of the invention, one string (instead of two) may be used for purposes of producing well fluid. For example, referring to FIG. 14, in these embodiments of the invention, only the first string 452 and not the string 454, is used. More specifically, in these embodiments of the invention, the valve 494 is located below the upper packer 462 and is part of the first string 452. Due to this arrangement, well fluid from the two production zones are commingled inside the central passageway of the string 452. Thus, many variations are possible and are within the scope of the appended claims.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A system usable with a well, comprising:

at least one isolation device to establish a first zone and a second zone hydraulically isolated from the first zone in the well;

a first production string adapted to extend through the first zone to the second zone and comprising an integrated perforating gun substantially concentric with a portion of the first production string not containing the perforating gun, the perforating gun adapted to fire inside the first zone without piercing the first production string so that the first production string communicates well fluid from the second zone after the perforating gun fires while maintaining the hydraulic isolation between the first and second zones; and a second production string extending into the first zone to communicate well fluid from the first zone.

2. The system of claim 1, wherein the perforating gun comprises perforating charges distributed completely around a longitudinal axis of the perforating gun.

3. The system of claim 1, wherein the second production string extends only partially into the first zone.

4. The system of claim 3, wherein the second production string does not extend radially between first production tubing string and a wellbore wall of the well.

5. The system of claim 1, wherein said at least one isolation device comprises at least one packer.

6. The system of claim 5, wherein the first production string and the second production string extend through a packer of said at least one isolation device.

7. The system of claim 1, wherein the perforating gun comprises perforating charges and at least one fin, and the perforating charges are disposed in said at least one fin.

8. The system of claim 7, wherein said at least one fin extends in a longitudinal direction along the perforating gun.

9. The system of claim 1, wherein the first perforating gun comprises a firing head adapted to be initiated by fluid pressure communicated through the second production string.

10. The system of claim 1, wherein the first perforating gun comprises a firing head adapted to be initiated by an inductively coupled coil run into the well.

11. An apparatus usable with a well, comprising:

a tubing comprising a housing and an internal passageway substantially concentric about a longitudinal axis of the tubing; and perforating charges attached to the housing to extend at least partially about the longitudinal axis along an arcuate path, the arcuate path having a center that is substantially concentric with the longitudinal axis, wherein the housing is adapted to hydraulically isolate the internal passageway from a region outside of the tubing before the perforating charges fire and maintain the hydraulic isolation after the perforating charges fire.

12. The apparatus of claim 11, further comprising:

at least one fin adapted to extend along the tubing, wherein the perforating charges are disposed in said at least one fin.

13. The apparatus of claim 12, wherein said at least one fin is adapted to centralize the tubing within a bore of the well when the apparatus is run into the bore.

14. The apparatus of claim 11, wherein the perforating charges are oriented in a radially outward direction from a longitudinal axis of the tubing.

15. The apparatus of claim 11, wherein the arcuate path extends three hundred sixty degrees about the longitudinal axis of the tubing.

16. A method usable with a well, comprising:

establishing a first zone in the well and a second zone located farther downhole in the well than the first zone and being hydraulically isolated from the first zone;

running a first production string into the well so that the first production string extends through the first zone and at least partially extends into the second zone, the first production string substantially concentric about a longitudinal axis and comprising an integrated perforating gun substantially concentric with the longitudinal axis;

running a second production string into the well so that the second production string at least partially extends into the first zone;

firing the perforating gun inside the first zone; and after the firing, maintaining hydraulic isolation between the first and second zones, using the first production string to communicate well fluid from the second zone and using the second production string to communicate well fluid from the first zone.

17. The method of claim 16, further comprising:

distributing perforating charges of the perforating gun in a phasing pattern that extends entirely around a longitudinal axis of the perforating gun.

18. The method of claim 16, wherein the act of running the second production string comprises not positioning the second production string radially between first production tubing string and a wellbore wall of the well.

19. The method of claim 16, further comprising:

setting at least one packer to establish at least one of the first zone and the second isolated zone.

20. The method of claim 19, wherein the first production string and the second production string extend through a packer.

21. The method of claim 16, further comprising:

disposing at least one perforating charge of the perforating gun on a fin of the first production string.

22. The method of claim 16, further comprising:

communicating fluid pressure through the second production string to fire the perforating gun.

* * * * *